US012534860B2

(12) United States Patent
Doy et al.

(10) Patent No.: US 12,534,860 B2
(45) Date of Patent: Jan. 27, 2026

(54) MAT COASTING ENABLEMENT FOR ASPHALT COMPACTOR

(71) Applicant: Caterpillar Inc., Peoria, IL (US)

(72) Inventors: Nathaniel S. Doy, Maple Grove, MN (US); Nicholas A. Oetken, Brooklyn Park, MN (US)

(73) Assignee: Caterpillar Inc., Peoria, IL (US)

( * ) Notice: Subject to any disclaimer, the term of this patent is extended or adjusted under 35 U.S.C. 154(b) by 919 days.

(21) Appl. No.: 17/751,901

(22) Filed: May 24, 2022

(65) Prior Publication Data

US 2023/0383480 A1 Nov. 30, 2023

(51) Int. Cl.

| | |
|---|---|
| ***E01C 19/23*** | (2006.01) |
| ***E01C 19/18*** | (2006.01) |
| ***E01C 19/26*** | (2006.01) |
| ***E01C 23/01*** | (2006.01) |

(52) U.S. Cl.
CPC ..... *E01C 19/26* (2013.01); *E01C 19/185* (2013.01); *E01C 23/01* (2013.01)

(58) Field of Classification Search
CPC ..... E01C 19/185; E01C 19/26; E01C 23/01
USPC ..... 404/84.05–84.8, 117
See application file for complete search history.

(56) References Cited

U.S. PATENT DOCUMENTS

| | | | | |
|---|---|---|---|---|
| 6,769,838 | B2 | 8/2004 | Potts | |
| 7,172,363 | B2 | 2/2007 | Olson et al. | |
| 8,099,218 | B2 * | 1/2012 | Glee | E01C 19/48 524/68 |
| 8,602,680 | B2 * | 12/2013 | Fischer | E02D 3/074 404/133.05 |
| 9,367,042 | B2 | 6/2016 | Oetken et al. | |
| 9,476,168 | B2 | 10/2016 | Oetken et al. | |
| 9,550,522 | B2 | 1/2017 | Oetken et al. | |
| 10,371,655 | B2 | 8/2019 | Delius et al. | |
| 2016/0060819 | A1 * | 3/2016 | Oetken | E01C 19/23 404/72 |
| 2021/0324588 | A1 | 10/2021 | Pawlik | |

FOREIGN PATENT DOCUMENTS

| | | |
|---|---|---|
| CN | 102251462 A | 11/2011 |
| WO | WO 00/70150 A1 | 11/2000 |

* cited by examiner

*Primary Examiner* — Raymond W Addie

(57) ABSTRACT

A compactor for operation on a surface includes: a frame; at least one compacting drum coupled to the frame; a drive system for accelerating and decelerating the compactor at an acceleration rate and a deceleration rate, respectively; and a controller for: controlling the drive system, and based on at least one variable, altering at least one of the acceleration rate and the deceleration rate.

20 Claims, 3 Drawing Sheets

MAT COASTING ENABLEMENT FOR ASPHALT COMPACTOR

FIELD

The present disclosure generally relates to controlling the ability of a compactor to coast over a mat, such as an asphalt mat, based on one or more variables relating to the mat.

BACKGROUND

Preparation of roadways, building sites, embankments, and other surfaces often requires compaction to produce desired material properties. Compactors are employed to compact various paving materials such as, for example, soil, gravel, and an asphalt material. Typically, compactor vehicles used with asphalt material mats include a vehicle body and a pair of drum members or drums rotatably mounted to the body. Such compactor vehicles generally function by rolling over sections of the formed material mat such that the drums compact the formed material mat with every pass made over a particular section, the drums also functioning to move the compactor vehicles. In a typical project for forming an asphalt mat, such as in roadway constructions, a paver vehicle forms a continuous mat of material behind the paver vehicle as the paver vehicle travels forward upon the base surface. One or more compactor vehicles follow the paver vehicle and generally roll over all sections of the formed material mat until the formed material mat is compacted to a desired degree.

In general, compactor vehicles decelerate and accelerate relatively slowly so as to avoid introducing defects on the asphalt mat. Slow deceleration can lead to the compactor vehicle feeling as if it coasts somewhat after a direction change, which is undesirable for general maneuvering, maintenance activities, and trailering.

U.S. Pat. No. 9,550,522 describes a system and method for limiting a turning speed of a compactor. The system comprises a speed sensor, a controller, and a temperature sensor configured to measure a temperature of a surface. The controller is configured to receive a travel speed and surface temperature, and to limit a turning speed of the compactor when the surface temperature is below a temperature threshold value. The controller can vary the speed of compactor based on the surface temperature.

International Publication No. WO 00/70150 describes a pavement temperature monitoring system used on a paver vehicle. The paver vehicle is capable of being operated at various travel speeds depending on pavement surface temperatures.

U.S. Pat. No. 9,476,168 describes a system and method for controlling a paving operation. A paving machine includes a thermal scanner that transmits a signal indicative of a scanned temperature of asphalt on which the paving machine operates in order to notify an operator of a compactor. The paving machine also includes a controller to control the speed of the paving machine based on the temperature data.

SUMMARY

One aspect of the present disclosure is directed to a compactor for operation on a surface, the compactor comprising: a frame; at least one compacting drum coupled to the frame; a drive system configured to accelerate and decelerate the compactor at an acceleration rate and a deceleration rate, respectively; and a controller configured to: control the drive system, and based on at least one variable, alter at least one of the acceleration rate and the deceleration rate.

Another aspect of the present disclosure is directed to a paving system for applying a paving material, the paving system comprising: a paver, comprising: at least one auger configured to apply the paving material; a first thermal scanner configured to sense a first surface temperature of a surface of the paving material at a location behind the paver with respect to a direction of travel of the paver; and a transmitter configured to transmit a first signal representative of the first surface temperature, and at least one compactor, comprising: a frame; at least one compacting drum coupled to the frame; a drive system configured to propel the at least one compactor at an acceleration rate and a deceleration rate; a receiver configured to receive the first signal; and a compactor controller configured to determine, based on the first signal, whether the first surface temperature meets or exceeds a first temperature threshold, and configured to alter at least one of the acceleration rate and the deceleration rate.

Yet another aspect of the present disclosure is directed to a method for operating a compactor on a surface, the method comprising: operating the compactor in a first drive mode, the first drive mode comprising a first set of acceleration and deceleration ramp rates for the compactor; determining a first variable with respect to an environment of the compactor; and based on the first variable, switching the compactor into a second drive mode, the second drive mode comprising a second set of acceleration and deceleration ramp rates for the compactor, wherein ramp rates of the first set of acceleration and deceleration ramp rates are faster than ramp rates of the second set of acceleration and deceleration ramp rates.

DETAILED DESCRIPTION

Figure 1:
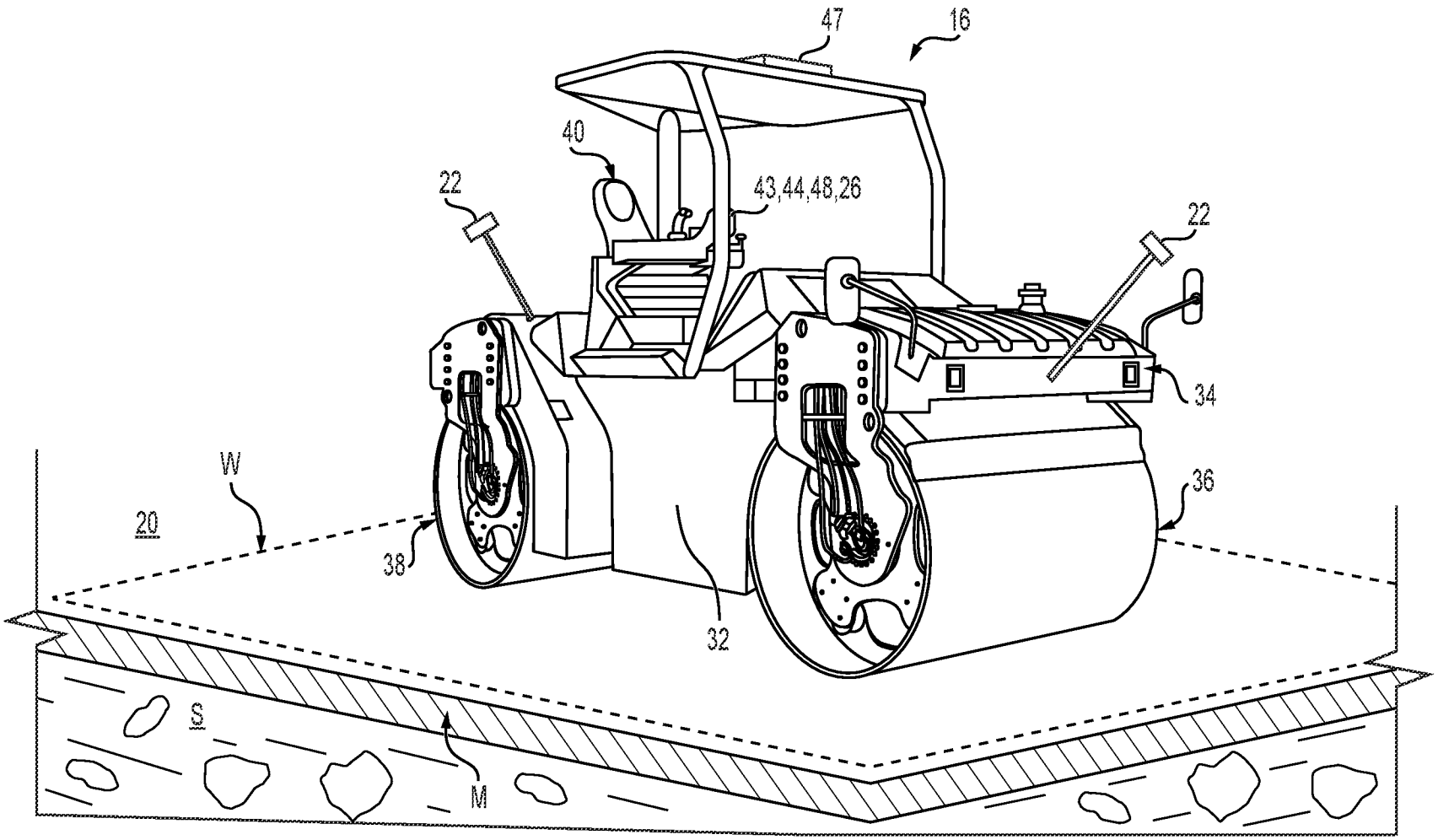
FIG. 1 shows a diagrammatic illustration of an exemplary compactor according to the present disclosure.
Figure 2:
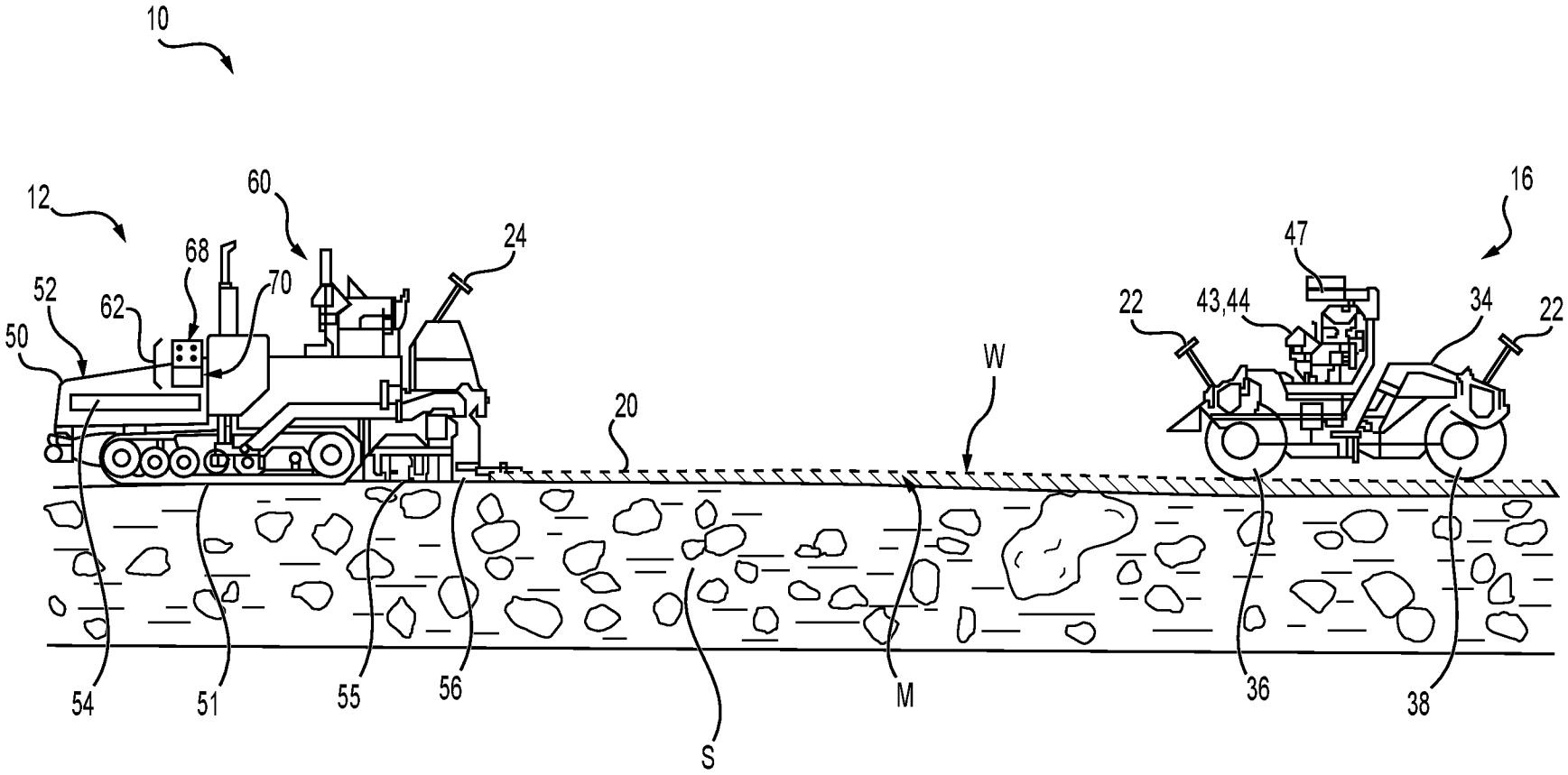
FIG. 2 shows a diagrammatic illustration of an exemplary paving system according to the present disclosure.

FIG. 1 illustrates portions of an exemplary compactor 16 according to one exemplary embodiment of the present disclosure. Compactor 16 is shown approximately as it might appear during paving of a paving material M on a sub-grade S. Compactor 16 may compact paving material M that has been dispensed on sub-grade S, for example, by paver 12, as shown in FIG. 2.

Turning back to FIG. 1, compactor 16 may generally include: a drive system 32 configured to generate power to propel compactor 16; a frame 34; an operator compartment 40; and at least one compacting drum, such as front compacting drum 36. In the described embodiment, compactor 16 also includes a rear compacting drum 38 coupled to frame 34. Front compacting drum 36 and rear compacting drum 38 are for compacting paving material M. Front compacting drum 36 and rear compacting drum 38 are in rolling contact with paving material M and are rotatably mounted to frame 34. In alternative embodiments, front compacting drum 36 or rear compacting drum 38 may be replaced with one or more tires. Drive system 32 propels compactor 16 by driving front compacting drum 36 and rear compacting drum 38. Front compacting drum 36 and rear compacting drum 38 support frame 34 above paving material M and, when rotated, allow compactor 16 to travel over paving material M. Drive system 32 may be any type of engine (internal combustion, gas, diesel, gaseous fuel, natural gas, propane, etc.), may be of any size, with any number of cylinders, and in any configuration ("V," in-line, radial, etc.). Drive system 32 may also use hydraulics to propel compactor 16. Alternatively, or in addition, drive system 32 may comprise one or more electric motors coupled to one or more batteries.

Compactor 16 may further include a compactor controller 43, including a receiver 44 configured to communicate with a transmitter 70 (e.g., on paver 12). It should be noted, however, that compactor controller 43 may not be integral with compactor 16, if desired. Compactor controller 43 may be operatively connected to a global positioning system ("GPS") device 47. GPS device 47 may be mounted on compactor 16, as shown in FIG. 1.

Compactor controller 43 may operate in a logical fashion to perform operations, execute control algorithms, store and retrieve data, and perform other desired operations. Compactor controller 43 may include or access memory, secondary storage devices, processors, and any other components for running a program. The memory and secondary storage devices may be in the form of read-only memory ("ROM") or random access memory ("RAM") or integrated circuitry that is accessible by compactor controller 43. Compactor controller 43 may be a single computer or may include more than one computer disposed to control various functions and/or features of compactor 16, wherein any of the one or more computers may be disposed remotely from compactor 16. The term "controller" is meant to be used in its broadest sense to include one or more computers and/or microprocessors that may be associated with compactor 16 and that may cooperate in controlling various functions and operations of compactor 16. The functionality of compactor controller 43 may be implemented in hardware and/or software without regard to the functionality. Although compactor controller 43 is shown as being integral with compactor 16, compactor controller 43 could be a laptop computer, a desktop computer, a tablet, a portable scanning device, or another mobile device, such as a smartphone, or any combination thereof.

Compactor controller 43 may be configured to receive signals and to in turn adjust acceleration and deceleration ramp rates of compactor 16 based on one or more variables. Potential variables include sensed temperatures, sensor signals, input signals, device signals, machine device signals, location conditions, and machine location conditions, among others. Acceleration and deceleration ramp rates are the rates at which acceleration and deceleration, respectively, (in this case, of compactor 16) increase or decrease. If the ramp rates are faster, then compactor 16 will accelerate and decelerate faster and coast less. If the ramp rates are slower, then compactor 16 will accelerate and decelerate slower and coast more. Slower acceleration and deceleration ramp rates are preferable when an operator of compactor 16 wishes to avoid having compactor 16 introduce defects on mat 20 (e.g., from front compacting drum 36 and/or rear compacting drum 38 cutting into mat 20 due to accelerating or decelerating too quickly). However, as noted herein, slow deceleration can lead compactor 16 to feel as if it coasts somewhat after a direction change, which is undesirable for general maneuvering, maintenance activities, and trailering. In such situations, it is therefore desirable to have faster acceleration and deceleration ramp rates so as to limit the coasting. Ramp rates for both acceleration and deceleration can be constant or vary over time, for example, in linear, curvilinear, or irregular fashion.

The ramp rates at which compactor 16 accelerates and decelerates may be set to be slower so as to enable coasting of compactor 16 and limit damage to mat 20 (e.g., from front compacting drum 36 and/or rear compacting drum 38 cutting into mat 20 due to accelerating or decelerating too quickly). Slower ramp rates may be referred to as a first drive mode. Conversely, the ramp rates may be set to be faster so as to disable or limit coasting of compactor 16, improving the general maneuvering of compactor 16. Faster ramp rates may be referred to as a second drive mode. For example, faster ramp rates may be used at times when compactor 16 is not compacting mat 20, such as during maintenance activities or trailing of compactor 16. While first and second drive modes suggest a binary choice amongst drive modes, additional drive modes (e.g., a third drive mode used during a transition between the first and second drive modes) may be possible.

The ramp rates can be adjusted vis-à-vis drive system 32. For example, if drive system 32 is combustion-based, in response to operator input, compactor controller 43 can apply a greater amount of fuel to drive system 32 to achieve faster ramp rates, or a smaller amount of fuel when slower ramp rates are desired. If drive system 32 is hydraulic, in response to operator input, hydraulic pressures within drive system 32 can be increased through compactor controller 43 resulting in faster ramp rates, but lowered by compactor controller 43 when slower ramp rates are desired. If drive system 32 is electric, in response to operator input, compactor controller 43 can increase voltage and/or current in drive system 32 to increase power and increase ramp rates, or decrease voltage and/or current in drive system 32 to decrease power when slower ramp rates are desired.

In an embodiment, the one or more variables used adjust acceleration and deceleration ramp rates of compactor 16 may relate to an environment in which compactor 16 is located. One example of a variable that can be used to set acceleration and deceleration ramp rates of compactor 16 is a surface temperature of formed material mat 20 after paving material M is applied to sub-grade S. The surface temperature can be sensed by compactor thermal scanner(s) 22, which can be mounted at the front and/or rear of frame 34 of compactor 16. If mounted at the front and rear of frame 34, compactor 16 could include two compactor thermal scanners 22 identical in structure and function. In this manner, the surface temperature of formed material mat 20 can be sensed at a location proximate to where either front compacting drum 36 or rear compacting drum 38 contacts mat 20 so that compactor 16 can travel forward or backward on mat 20 without impacting the temperature sensing.

The operating characteristics of compactor 16 can be changed depending on the surface temperature of mat 20. For example, if the surface temperature exceeds a first threshold, compactor 16 can be set to operate in the first drive mode (i.e., with slower acceleration and deceleration ramp rates) so as to allow compactor 16 to coast more. If the surface temperature does not exceed the first threshold, compactor 16 can be set to operate in the second drive mode (i.e., with faster acceleration and deceleration ramp rates) so that compactor 16 coasts less and becomes more easily maneuverable. The surface temperature can be checked against other thresholds (e.g., a second threshold, a third threshold, etc.), if desired, then the operation of compactor 16 correspondingly adjusted.

Compactor controller 43 may be configured to receive electrical signals from compactor thermal scanner(s) 22, with the electrical signals being indicative of the sensed surface temperature of material mat 20. In certain implementations the electrical signals provided by compactor thermal scanner(s) 22 may be processed by a compactor thermal scan processor 26, which may be part of or separate from compactor controller 43. Processing by compactor thermal scan processor 26 may include converting a plurality of parallel input signals from a thermal detector array in compactor thermal scanner(s) 22 into a serial output signal. Compactor thermal scan processor 26 may include a converter circuit for converting the parallel input signals into a plurality of current signals. An integration circuit may also be provided with compactor thermal scan processor 26 for integrating the current signals for a predetermined length of time. The integration circuit may be operable to generate a plurality of voltages in response to the current signals. A storage circuit may also be provided to generate and store a plurality of storage signals that are proportional to the plurality of voltages generated by the integration circuit. A multiplexing circuit may also be provided to generate the serial output signal from the storage signals generated by the storage circuit.

Compactor thermal scanner(s) 22 may be any appropriate type of thermal measuring or sensing device/system and preferably is capable of "remotely" sensing the temperature of formed material mat 20 without the need for any portion of compactor thermal scanner(s) 22 to make physical contact with mat 20. However, in certain alternative implementations, appropriate "contact" types of temperature sensors, such as, for example, a thermocouple with a sensing junction may be used. With such "contact" types of temperature sensors, caution must be taken to ensure that the contact type of temperature sensors do not scratch or otherwise damage mat 20 or become themselves damaged by contact with mat 20. Compactor thermal scanner(s) 22 may comprise either thermal imagers, thermal scanners, or thermal imagers operating in "line-scan" mode. In some exemplary implementations, a thermal scanner such as the thermal scanner sold under the trademark MOBA PAVE-IR™, may be used. Compactor thermal scanner(s) 22 may be mounted on frame 34 of compactor 16 at a height sufficiently above mat 20 so as to be capable of viewing, and thus imaging or scanning, across substantially the entire width of mat 20. In this manner, compactor thermal scanner(s) 22 is/are mounted on compactor 16 in an orientation that provides a clear line of sight to freshly applied asphalt material M being laid down as mat 20 immediately in front of compactor 16 in a direction of travel of compactor 16.

Compactor thermal scanner(s) 22 may include one or more temperature detectors and/or sensors, such as, for example, a video camera with an infrared filter, with the temperature detector and/or sensor receiving heat or infrared energy from the top surface of mat 20, and generating electrical signals corresponding to the thermal image of the surface. Compactor thermal scanner(s) 22 may include one or more temperature detectors and/or sensors, as well as optical elements (e.g., one or more mirrors) to present the one or more temperature detectors and/or sensors with infrared energy from a plurality of locations on mat 20 to construct a thermal image of the top surface of mat 20.

Compactor thermal scanner(s) 22 may be configured to generate a plurality of electrical signals corresponding to the sensed mat temperature at a plurality of locations on mat 20. Preferably, compactor thermal scanner(s) 22 are capable of repeatedly scanning across at least a portion of the width of mat 20 so as to periodically sense the mat temperature at successive sections of mat 20 along or with respect to the direction of travel of compactor 16. Thus, each side-to-side pass of the thermal scanner across the width of mat 20 provides temperature measurements for a strip-like section of mat 20 and the series of repeated passes and scans provides temperature information on each successive strip of mat 20 as compactor 16 continues to travel along and compact mat 20.

The electrical signals generated by compactor thermal scanner(s) 22, which are representative of the sensed mat temperature at each of the plurality of locations on mat 20, may be aggregated, processed by compactor thermal scan processor 26, and transmitted by appropriate means (e.g., wireless, cellular, Wi-Fi, etc.) to display 48 mounted on compactor 16. A graphical image may therefore be generated by display 48 that is representative of the sensed mat temperature profile of a section of mat 20 corresponding to the plurality of electrical signals received from compactor thermal scanner 22. Display 48 is capable of periodically updating graphical images that are representative of the formed mat temperature at successive sections on mat 20 as compactor 16 continues to travel.

In alternative implementations, compactor 16 may include any of a number of different audio, video, or audio/video alerts 49 that warn an operator of compactor 16 when the temperature of material mat 20 has exceeded a predetermined maximum temperature or is less than a predetermined minimum temperature. In this manner, the electrical signals generated by compactor thermal scanner(s) 22 may be processed by compactor thermal scan processor 26 and transmitted to compactor 16 as an alert 49 to notify a compactor operator that the temperature of at least a portion of mat 20 is outside of a preferred range.

Another example of a variable that can be used to set acceleration and deceleration ramp rates of compactor 16 is a geographical location of compactor 16. For example, using GPS device 47, compactor controller 43 of compactor 16 can determine its location with respect to a work area W, as shown in dashed lines in FIG. 1. Work area W may include a subset of the area of mat 20. Work area W may also be a geo-fenced area, for example. If inside work area W it is desirable to have slower ramp rates, compactor controller 43 may then adjust the ramp rates accordingly so as to operate compactor 16 in the first drive mode, decreasing the likelihood that compactor 16 introduces defects on mat 20 (e.g., from front compacting drum 36 and/or rear compacting drum 38 cutting into mat 20 due to accelerating or decelerating too quickly). Outside work area W, however, faster ramp rates may be desired. Using GPS device 47, compactor controller 43 can determine when compactor 16 is located outside of work area W. Controller 43 can then increase the ramp rates accordingly so as to operate compactor 16 in the second drive mode, increasing the maneuverability of compactor 16. Compactor 16 and its relation to work area W can be displayed on display 48. In alternative implementations, compactor 16 may include any of a number of different audio, video, or audio/video alerts 49 that warn an operator of compactor 16 when compactor 16 has moved into or out of work area W.

Instead of relying on one or more variables associated with compactor 16, the acceleration and deceleration ramp rates can also be set manually by the operator of compactor 16.

FIG. 2 illustrates an exemplary paving system 10 according to an embodiment of the present disclosure. Paving system 10 may include a plurality of different machines, and in the illustrated embodiment includes a paving machine or paver 12 and a compactor 16, such as compactor 16 shown in FIG. 1. The various machines of paving system 10 are shown approximately as they might appear during paving of a paving material M on a sub-grade S. Paver 12 may travel across sub-grade S and dispense paving material M, which may be subsequently compacted by compactor 16. FIG. 2 shows a single compactor 16, although embodiments of the present disclosure may include a plurality of compactors 16.

Paver 12 may generally include a frame 50 configured to support a hopper 52 for temporarily storing paving material M. In the described embodiment, paving material M may be an asphalt material comprising an aggregate and a binder. It should be noted, however, that other materials may alternatively be utilized, such as soil, gravel, and other known paving materials. Paver 12 may further include one or more feeder conveyor 54 and auger(s) 55 configured to dispense paving material M from hopper 52 onto sub-grade S for conventional leveling, preliminary compacting, thickness control, etc., via a screed 56. Paver 12 may further include a plurality of ground-engaging elements 51, such as wheels or tracks configured to propel paver 12, and a paver operator station 60.

Paver 12 may also include a paver thermal scanner 24 mounted at the rear of frame 50, and configured to sense the surface temperature of formed material mat 20 after it is applied to sub-grade S by screed 56. A paver controller 62 may be mounted on frame 50, in paver operator station 60, or in certain alternative implementations, may be external to paver 12. As with compactor controller 43 and compactor thermal scanner(s) 22 of compactor 16, paver controller 62 may be configured to receive an electrical signal from paver thermal scanner 24, with the electrical signal being indicative of the sensed surface temperature of material mat 20. In certain implementations the electrical signal provided by paver thermal scanner 24 may be processed by paver thermal scan processor 68, which may be part of or separate from paver controller 62. Processing by paver thermal scan processor 68 may include converting a plurality of parallel input signals from a thermal detector array in paver thermal scanner 24 into a serial output signal. Paver thermal scan processor 68 may include a converter circuit for converting the parallel input signals into a plurality of current signals. An integration circuit may also be provided with paver thermal scan processor 68 for integrating the current signals for a predetermined length of time. The integration circuit may be operable to generate a plurality of voltages in response to the current signals. A storage circuit may also be provided to generate and store a plurality of storage signals that are proportional to the plurality of voltages generated by the integration circuit. A multiplexing circuit may also be provided to generate the serial output signal from the storage signals generated by the storage circuit.

Like compactor thermal scanner(s) 22, paver thermal scanner 24 may be any appropriate type of thermal measuring or sensing device/system and preferably is capable of "remotely" sensing the temperature of formed material mat 20 without the need for any portion of paver thermal scanner 24 to make physical contact with mat 20. However, in certain alternative implementations, an appropriate "contact" type of temperature sensor, such as, for example, a thermocouple with a sensing junction may be used. As before, with such a "contact" type of temperature sensor, caution must be taken to ensure that the contact type of temperature sensor does not scratch or otherwise damage mat 20 or become itself damaged by contact with mat 20. Paver thermal scanner 24 may comprise either a thermal imager, a thermal scanner, or a thermal imager operating in "line-scan" mode. In some exemplary implementations, a thermal scanner such as the thermal scanner sold under the trademark MOBA PAVE-IR™ may be used. Paver thermal scanner 24 may be mounted at rear end of paver 12 at a height sufficiently above mat 20 so as to be capable of viewing, and thus imaging or scanning, across substantially the entire width of mat 20. In this manner, paver thermal scanner 24 is mounted on paver 12 in an orientation that provides a clear line of sight to freshly applied asphalt material M being laid down as mat 20 immediately behind paver 12 with respect to a direction of travel of paver 12.

Paver thermal scanner 24 may include one or more temperature detectors and/or sensors, such as, for example, a video camera with an infrared filter, with the temperature detector and/or sensor receiving heat or infrared energy from the top surface of mat 20, and generating electrical signals corresponding to the thermal image of the surface. Paver thermal scanner 24 may include one or more temperature detectors and/or sensors, as well as optical elements (e.g., one or more mirrors) to present the one or more temperature detectors and/or sensors with infrared energy from a plurality of locations on mat 20 to construct a thermal image of the top surface of mat 20.

Paver thermal scanner 24 may be configured to generate a plurality of electrical signals corresponding to the sensed mat temperature at a plurality of locations on mat 20. The electrical signals generated by paver thermal scanner 24, which are representative of the sensed mat temperature at each of the plurality of locations on mat 20, may be aggregated, processed by paver thermal scan processor 68, and transmitted by appropriate means (e.g., wireless, cellular, Wi-Fi, etc.) to a display device mounted on paver 12 or display 48 mounted on compactor 16. In alternative implementations, the electrical signals generated by paver thermal scanner 24 may be processed by paver thermal scan processor 68 and transmitted to compactor 16 as an alert 49 to notify a compactor operator that the temperature of at least a portion of mat 20 is outside of a preferred range. Preferably, paver thermal scanner 24 is capable of repeatedly scanning across at least a portion of the width of mat 20 so as to periodically sense the mat temperature at successive sections of mat 20 along or with respect to the direction of travel of paver 12. Thus, each side-to-side pass of the thermal scanner across the width of mat 20 provides temperature measurements for a strip-like section of mat 20 and the series of repeated passes and scans provides temperature information on each successive strip of mat 20 as paver 12 continues to travel and apply the mat 20.

Paving system 10 may be used to sense one or more variables used to adjust acceleration and deceleration ramp rates of compactor 16. For example, in an embodiment, compactor 16 may include a receiver 44 configured to receive from, for example, transmitter 70 of paver 12, signals indicative of the temperature of mat 20, as well as signals indicative of the geographical position on mat 20 at which the temperatures were measured, and the geographical position of compactor 16. Compactor 16 may include one or more audio, video, or audio and video devices that are capable of receiving processed electrical signals from the paver 12 (e.g., from paver controller 62), or from one or more controllers external to paver 12 that receive the processed electrical signals from paver 12, such as display 48. Compactor controller 43, vis-à-vis receiver 44, may be capable of receiving the plurality of electrical signals from paver thermal scanner 24 and displaying the sensed temperature (e.g., on display 48) to the compactor operator, and/or generating an alert 49. In some implementations, a graphical image may be generated by display 48 that is representative of the sensed mat temperature profile of a section of the mat 20 corresponding to the plurality of electrical signals received from paver thermal scanner 24.

Another example of a variable that can be used to set acceleration and deceleration ramp rates of compactor 16 is a geographical location of paving system 10 or the machines of paving system 10. For example, using GPS device 47 on compactor 16, compactor controller 43 can determine the location of paving system 10, or the machines thereof, with respect to a work area W, as shown in dashed lines in FIG. 2. Work area W may include a subset of the area of mat 20. Work area W may also be a geo-fenced area, for example. If inside work area W it is desirable to have slower ramp rates, compactor controller 43 may then adjust the ramp rates accordingly so as to operate compactor 16 in the first drive mode, decreasing the likelihood that compactor 16 introduces defects on mat 20 (e.g., from front compacting drum 36 and/or rear compacting drum 38 cutting into mat 20 due to accelerating or decelerating too quickly). Outside work area W, however, faster ramp rates may be desired. Using GPS device 47, compactor controller 43 can determine when compactor 16 is located outside of work area W. Controller 43 can then increase the ramp rates accordingly so as to operate compactor 16 in the second drive mode, increasing the maneuverability of compactor 16. Compactor 16, paver 12, and their relation to work area W can be displayed on display 48. In alternative implementations, compactor 16 may include any of a number of different audio, video, or audio/video alerts 49 that warn an operator of compactor 16 or paver 12 when compactor 16 has moved into or out of work area W.

Instead of relying on one or more variables associated with paving system 10, the acceleration and deceleration ramp rates can also be set manually by the operator of compactor 16 or of paver 12.

Figure 3:
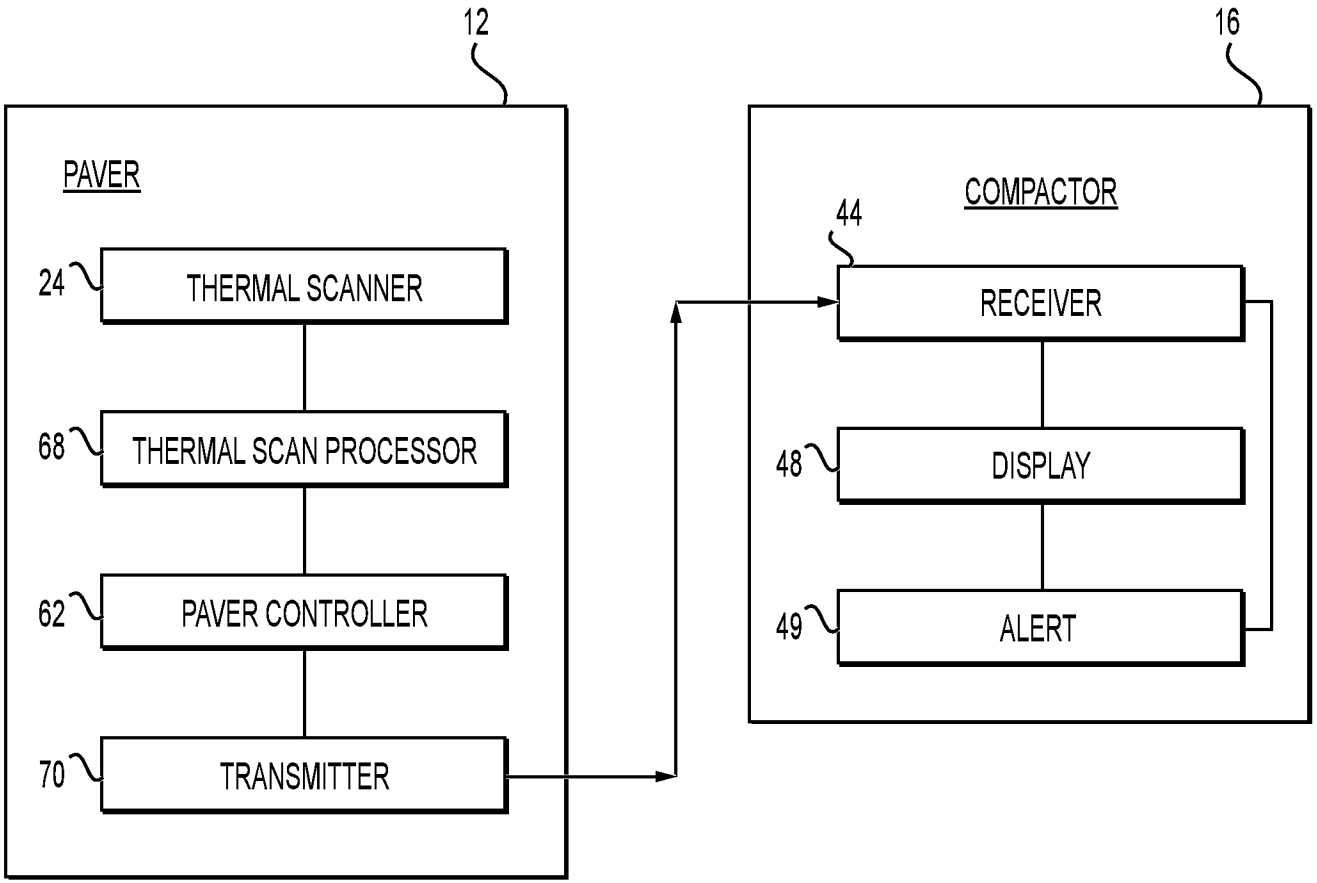
FIG. 3 is a block diagram of an exemplary control configuration for the paving system of FIG. 2.

FIG. 3 is a block diagram of an exemplary control configuration for paving system 10 of FIG. 2. Paver 12 may include a thermal scan processor 68 configured to receive and process electrical signals from thermal scanner 24, a paver controller 62 configured to determine whether the temperature of the formed material mat 20 of asphalt material is within a preferred range of temperatures, and a transmitter 70 configured to send a signal to a compactor 16 following behind paver 12. In various alternative implementations, paver controller 62 may be located partially or completely remote from paver 12. For example, paver controller 62 may be physically located at a mobile command center in a vicinity of the work area W where paver 12 and compactor 16 are operating, or at a central command site communicating with paver 12 and compactor 16 via satellite, over wireless networks, cellular networks, Wi-Fi networks, or other communication networks.

Compactor 16 may include a receiver 44 configured to receive the signal transmitted by paver controller 62 and transmitter 70 on paver 12. A display 48 on compactor 16 may generate and display a graphical image representative of the sensed formed material mat temperature profile of a section of formed material mat 20 corresponding to the plurality of electrical signals produced by thermal scanner 24 on paver 12. The graphical image may be periodically updated with sensed mat temperature information from each successive pass of thermal scanner 24 across mat 20 such that the graphical image scrolls on display 48 of compactor 16 as paver 12 travels and mat 20 is being formed. In some exemplary implementations of paving system 10, a thermal scanner such as the thermal scanner sold under the trademark MOBA PAVE-IR™ may be used.

In some exemplary implementations, the electrical signals generated by thermal scanner 24 may be processed by thermal scan processor 68 and transmitted to compactor 16 as an alert 49 to notify a compactor operator that the temperature of at least a portion of mat 20 is outside of a preferred range. The operator of compactor 16 can then switch compactor 16 from first drive mode to second drive mode or vice versa. For example, if the temperature of at least a portion of mat 20 is below a predetermined threshold, the operator of compactor 16 can switch compactor 16 from the first drive mode into the second drive mode in order to increase maneuverability of compactor 16. Alternatively, if the temperature of at least a portion of mat 20 is above a predetermined threshold, the operator of compactor 16 can switch compactor 16 from the second drive mode into the first drive mode to enable compactor 16 to coast more, reducing the likelihood that operation of compactor 16 introduces defects on mat 20 (e.g., from front compacting drum 36 and/or rear compacting drum 38 cutting into mat 20 due to accelerating or decelerating too quickly).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

INDUSTRIAL APPLICABILITY

In general, the compactor, paving system, and method of mat coasting enablement of the present disclosure are applicable for use in various industrial applications, including preparation of roadways, building sites, embankments with paving materials such as, for example, an asphalt material.

Compacting the asphalt material with a compactor according to the present disclosure helps the compactor avoid introducing defects in an asphalt mat on which the compactor is operating, in particular by lowering acceleration and deceleration ramp rates of the compactor while the compactor is compacting the asphalt mat. The lower acceleration and deceleration ramp rates cause the compactor to coast more than it would otherwise.

However, when the compactor, paving system, and method of the present disclosure determine, based on one or more variables, that the compactor is not actively compacting the asphalt mat, the acceleration and deceleration ramp rates of the compactor are raised, allowing the compactor to coast less and therefore have increased maneuverability, e.g., during trailering of the compactor. In such cases, there is a lowered risk of introducing defects in the asphalt mat.

The present disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A compactor for operation on a surface, the compactor comprising:

a frame;

at least one compacting drum coupled to the frame;

a drive system configured to accelerate and decelerate the compactor at a plurality of acceleration and deceleration rates, respectively; and a controller associated with a plurality of drive modes associated with the plurality of acceleration and deceleration rates, configured to:

control the drive system, and based on at least one variable, place the compactor in a first drive mode, of the plurality of drive modes, associated with a first acceleration rate and a first deceleration rate of the plurality of acceleration and deceleration rates.

2. The compactor of claim 1, further comprising:

a global positioning system (GPS) device, wherein the controller is configured to determine, using the GPS device, a location of the compactor with respect to a work area on the surface, the location comprising a first variable of the at least one variable.

3. The compactor of claim 2, wherein, if the location is inside the work area, at least one of the first acceleration rate or the first deceleration rate is lower than at least one of a second acceleration rate or a second deceleration rate, of the plurality of acceleration and deceleration rates, respectively.

4. The compactor of claim 2, wherein, if the location is outside the work area, at least one of the first acceleration rate or the first deceleration rate is greater than at least one of a second acceleration rate or a second deceleration rate, of the plurality of acceleration and deceleration rates, respectively.

5. The compactor of claim 1, further comprising:

at least one thermal scanner configured to sense a surface temperature of the surface on which the compactor is disposed, the surface temperature comprising a first variable of the at least one variable.

6. The compactor of claim 5, wherein the at least one thermal scanner comprises two thermal scanners, a first of the two thermal scanners being disposed at a front of the frame with respect to a direction of travel of the compactor, and a second of the two thermal scanners being disposed at a rear of the frame with respect to the direction of travel.

7. The compactor of claim 5, wherein the controller is configured to:

receive, from the at least one thermal scanner, a signal representative of the surface temperature, and determine, using the signal, whether the surface temperature meets or exceeds a temperature threshold.

8. The compactor of claim 7, wherein, if the surface temperature meets or exceeds the temperature threshold, at least one of the first acceleration rate or the first deceleration rate is lower than at least one of a second acceleration rate or a second deceleration rate, of the plurality of acceleration and deceleration rates, respectively.

9. The compactor of claim 7, wherein, if the surface temperature does not meet or exceed the temperature threshold, at least one of the first acceleration rate or the first deceleration rate is greater than at least one of a second acceleration rate or a second deceleration rate, of the plurality of acceleration and deceleration rates, respectively.

10. The compactor of claim 7, further comprising:

a global positioning system (GPS) device, wherein the controller is configured to determine, using the GPS device, a location of the compactor with respect to a work area on the surface, the location comprising a second variable of the at least one variable, wherein, if the surface temperature meets or exceeds the temperature threshold and the location is inside the work area, at least one of the first acceleration rate or the first deceleration rate is lower than at least one of a second acceleration rate or a second deceleration rate, of the plurality of acceleration and deceleration rates, respectively, or wherein, if the surface temperature does not meet or exceed the temperature threshold or the location is outside the work area, the at least one of the first acceleration rate or the first deceleration rate is greater than at least one of a second acceleration rate or a second deceleration rate, of the plurality of acceleration and deceleration rates, respectively.

11. A paving system for applying a paving material, the paving system comprising:

a paver, comprising:

at least one auger configured to apply the paving material;

a first thermal scanner configured to sense a first surface temperature of a surface of the paving material at a location behind the paver with respect to a direction of travel of the paver; and a transmitter configured to transmit a first signal representative of the first surface temperature, and at least one compactor, comprising:

a frame;

at least one compacting drum coupled to the frame;

a drive system configured to propel the at least one compactor at a plurality of acceleration and deceleration rates;

a receiver configured to receive the first signal; and a compactor controller, associated with a plurality of drive modes associated with the plurality of acceleration and deceleration rates, configured to:

determine, based on the first signal, whether the first surface temperature meets or exceeds a first temperature threshold, and place, based on determining whether the first surface temperature exceeds the compactor in a first drive mode, of the plurality of drive modes, associated with a first accelerate rate and a first deceleration rate of the plurality of acceleration and deceleration rates, wherein at least one of the first acceleration rate or the first deceleration rate is different from at least one of a second acceleration rate or a second deceleration rate, of the plurality of acceleration and deceleration rates, respectively.

12. The paving system of claim 11, wherein, if the first surface temperature meets or exceeds the first temperature threshold, the at least one of the first acceleration rate and the first deceleration rate is lower than the at least one of the second acceleration rate or the second deceleration rate.

13. The paving system of claim 11, wherein, if the first surface temperature does not meet or exceed the first temperature threshold, the at least one of the first acceleration rate or the first deceleration rate is greater than the at least one of the second acceleration rate or the second deceleration rate, respectively.

14. The paving system of claim 11, wherein the at least one compactor comprises a plurality of compactors.

15. The paving system of claim 11, wherein the at least one compactor comprises a second thermal scanner configured to sense a second surface temperature of the surface of the paving material at a location in front of the compactor with respect to a direction of travel of the compactor.

16. The paving system of claim 15, wherein, if the second surface temperature meets or exceeds a second temperature threshold, the at least one of the first acceleration rate or the first deceleration rate is lower than at least one of the second acceleration rate or the second deceleration rate, respectively.

17. The paving system of claim 15, wherein, if the second surface temperature does not meet or exceed a second temperature threshold, the at least one of the first acceleration rate or the first deceleration rate is greater than at least one of the second acceleration rate or the second deceleration rate, respectively.

18. A method for operating a compactor on a surface, the method comprising:

operating the compactor in a first drive mode, the first drive mode comprising a first set of acceleration and deceleration ramp rates for the compactor;

determining a first variable with respect to an environment of the compactor; and based on the first variable, switching the compactor into a second drive mode, the second drive mode comprising a second set of acceleration and deceleration ramp rates for the compactor, wherein ramp rates of the first set of acceleration and deceleration ramp rates are faster than ramp rates of the second set of acceleration and deceleration ramp rates.

19. The method of claim 18, wherein determining the first variable comprises sensing a surface temperature of the surface, and wherein the switching into the second drive mode occurs if the surface temperature meets or exceeds a threshold.

20. The method of claim 18, wherein determining the first variable comprises ascertaining a location of the compactor with respect to a work area on the surface, and wherein the switching into the second drive mode occurs if the location is inside the work area.

* * * * *